United States Patent [19]

Vieland et al.

[11] 4,323,813

[45] Apr. 6, 1982

[54] SPRING-LOADED RESISTIVE LENS STRUCTURE FOR ELECTRON GUN

[75] Inventors: Leon J. Vieland, Princeton; Vincent M. Cannuli, Mercerville, both of N.J.

[73] Assignee: RCA Corporation, Princeton, N.J.

[21] Appl. No.: 114,514

[22] Filed: Jan. 23, 1980

[51] Int. Cl.[3] ..... H01J 1/88; H01J 19/42

[52] U.S. Cl. ..... 313/250; 313/257; 313/268; 313/451; 313/456; 313/476

[58] Field of Search ..... 313/250, 450, 479, 256, 313/257, 268, 444, 451, 456, 476

[56] References Cited

U.S. PATENT DOCUMENTS

| | | | |
|---|---|---|---|
| 2,310,811 | 2/1943 | Schantl et al. | 313/250 X |
| 3,758,802 | 9/1973 | Kubo et al. | 313/479 |
| 3,882,348 | 5/1975 | Paridaens | 313/450 |
| 3,909,655 | 9/1975 | Grimmett et al. | 313/450 |
| 3,950,667 | 4/1976 | DeJong et al. | 313/450 |
| 4,143,298 | 3/1979 | Bing et al. | 313/450 |
| 4,220,893 | 9/1980 | Miller et al. | 313/450 |
| 4,255,689 | 3/1981 | Fischman et al. | 313/479 |

FOREIGN PATENT DOCUMENTS

| | | | |
|---|---|---|---|
| 1273703 | 7/1968 | Fed. Rep. of Germany | 313/450 |

*Primary Examiner*—Saxfield Chatmon, Jr.
*Attorney, Agent, or Firm*—Eugene M. Whitacre; Dennis H. Irlbeck; Vincent J. Coughlin, Jr.

[57] ABSTRACT

The electron gun comprises an electron lens assembly including a pair of terminal electrodes fixedly mounted along a pair of glass support rods. Disposed between the terminal electrodes is a resistive lens stack of alternate apertured electrode plates and resistive spacer blocks. The electrode plates and resistive spacer blocks are urged into good electrical contact with each other and with the terminal electrodes by a plurality of leaf springs. The electrode plates are preferably lightly contacted by the glass support rods to prevent lateral movement of the plates without preventing their spring-urged contact with the resistive blocks.

7 Claims, 4 Drawing Figures

SPRING-LOADED RESISTIVE LENS STRUCTURE FOR ELECTRON GUN

BACKGROUND OF THE INVENTION

This invention relates to electron guns, and especially to electron guns for use in television picture tubes. The invention is particularly directed to electron lenses for such guns.

It is well known that spherical aberration in an electron lens can be desirably reduced by making the field of the lens weaker and extending it over a greater length along the path of the beam. It is also well known that one type of lens for doing this is the resistive lens wherein a plurality of metal electrode plates are arranged in serial fashion, and a voltage gradient is established along the lens by applying different voltages to the different plates by way of a resistive bleeder element provided within the vacuum envelope of the electron tube itself.

The prior art has disclosed various forms of plural-plate resistive lenses, for example: FIG. 1 of U.S. Pat. No. 2,143,390 issued to F. Schroter on Jan. 10, 1939; U.S. Pat. No. 3,932,786 issued to F. J. Campbell on Jan. 13, 1976; and FIG. 3 of U.S. Pat. No. 4,091,144 issued to J. Dresner et al on May 23, 1978. Although Schroter shows the bleeder resistor only schematically, Campbell discloses a practical embodiment of a bleeder resistor disposed on a glass support rod (bead) of the electron gun structure, and Dresner et al shows a practical embodiment of a stack of alternate metal electrodes and insulator blocks with a resistive bleeder coating applied along one edge of the stack. However, in practice, the Campbell structure requires many connectors to make contact between the series of apertured electrodes and the bleeder resistor, and moreover increases the likelihood of cracked beads during fabrication due to the large number of electrodes embedded in the glass beads. Furthermore, both the Campbell and Dresner et al lenses depend for their field accuracy upon the uniformity of the resistive bleeder coating, the fabrication of which is very difficult to control.

An improvement over the Dresner et al structure is disclosed in U.S. Application Ser. No. 51400 filed June 25, 1979 by B. Abeles, and incorporated herein by reference for purposes of disclosure. The Abeles lens structure comprises a plurality of apertured electrodes and resistive spacer blocks alternately stacked and brazed together to form an electrically continuous structure. The resistive blocks comprise insulator blocks which, prior to being assembled into a unitary stack with the apertured electrode plates, are each coated along at least a portion of one surface with a suitable resistive material. Such precoating (i.e. coating prior to assembly) of the blocks allows them to be pretested before assembly and sorted according to their resistivity characteristics. The Abeles construction has proved to be electrically and mechanically acceptable, but involves relatively high costs entailed in the brazing together of the blocks and plates.

SUMMARY OF THE INVENTION

The present novel gun uses separate precoated resistive blocks alternately stacked with apertured electrode plates as in the Abeles lens, but rather than brazing the resistive blocks and plates together, they are secured together in mutual electrical contact between two fixed terminal electrodes by spring means acting axially along the stack. Preferably, to insure maintenance of alignment during operational cycling, the electrode plates are very lightly contacted by a pair of glass support rods into which the terminal electrodes are fixed, so as to preclude any lateral movement of the electrode plates. This contact should not be so great as to embed the electrode plates so far into the glass rods as to rigidly fix the plates against axial urging by the spring means. To do so might adversely effect the maintenance of electrical continuity along the lens stack.

DETAILED DESCRIPTION OF THE PREFERRED EMBODIMENT

The present invention is shown as embodied in a 3-beam in-line electron gun similar to that described in U.S. Pat. No. 3,772,554 issued to R. H. Hughes on Nov. 12, 1973, but employing an additional lens electrode for tri-potential operation. The Hughes patent is incorporated by reference herein for the purpose of disclosure. The invention may, however, be used in other types of electron guns.

Figure 1:
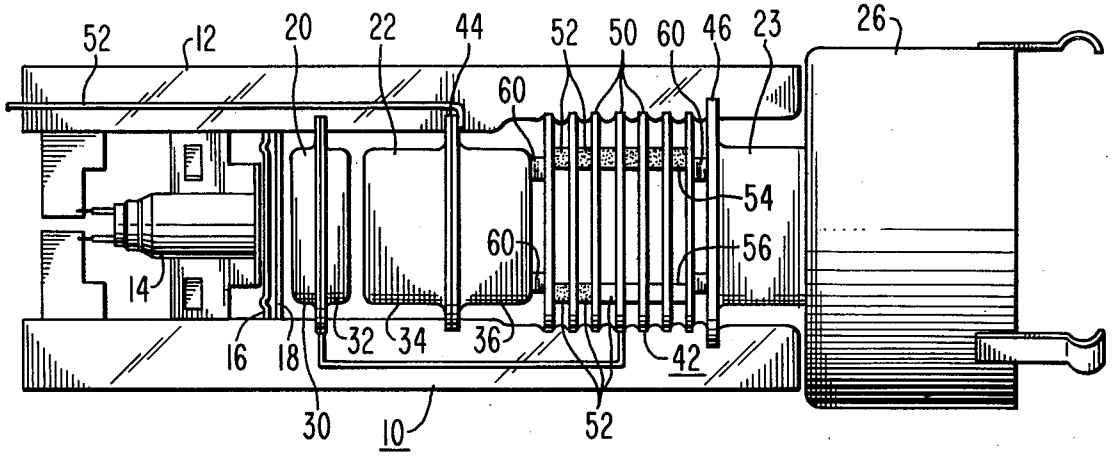
FIGS. 1 and 2 are elevation views of the novel electron gun as viewed from two planes at right angles to each other. Parts are broken away in FIG. 2 to reveal internal details.
Figure 2:
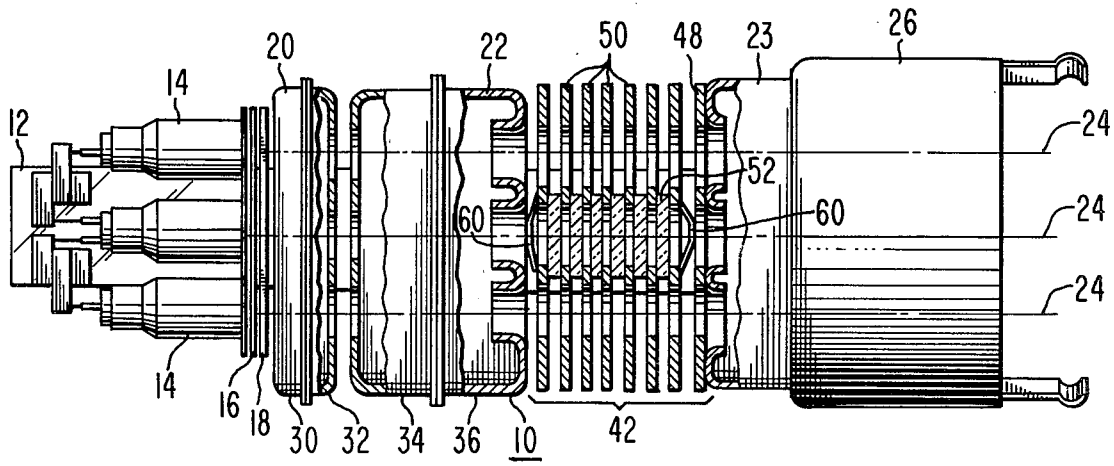

As shown in FIGS. 1 and 2, an electron gun 10 comprises two parallel glass support rods (beads) 12 on which various electron gun elements are mounted. At one end of the support rods 12 are mounted three cup-shaped cathodes 14 having emissive surfaces on their end walls. Mounted in spaced relation beyond the cathodes 14 are a control grid electrode 16, a screen grid electrode 18, and first, second, and third accelerating and focusing electrodes 20, 22, and 23 respectively. Three electron beams are projected from the three cathodes 14 along three coplanar beam paths 24 through apertures in the electrodes. A shield cup 26 is attached to the far end of the third accelerating and focusing electrode 23.

The control grid electrode 16 and the screen grid electrode 18 comprise substantially flat metal members, each containing three in-line apertures which are aligned with the beam paths 24.

The first accelerating and focusing electrode 20 comprises two somewhat rectangularly shaped cups 30 and 32 joined at their open ends. The closed ends of the cups 30 and 32 each have three in-line apertures with each aperture being aligned with a separate beam path 24. The second accelerating and focusing electrode 22 comprises two somewhat rectangular cups 34 and 36 also joined at their open ends. The cups 34 and 36 are apertured similarly to that of the first electrode cups 30 and 32. The third accelerating and focusing electrode 23 comprises a single similarly apertured rectangular cup with its open end facing the cathodes. The shield cup 26 is circular, and its base is attached to the closed end of the third accelerating and focusing electrode 23. The shield cup 26 also has three in-line apertures through its base with each aperture being aligned with one of the beam paths 24.

In operation, the electron gun 10 is designed to have its main focus field established between the second and third accelerating and focusing electrodes 22 and 23. To this end a novel resistive lens structure 42 is disposed between, and includes, these electrodes.

The second and third accelerating and focusing electrodes 22 and 23, which serve as terminal electrodes of the resistive lens structure 42, are fixedly mounted to the insulator support rods 12. This mounting is accomplished by peripheral projections 44 and 46 on the terminal electrodes 22 and 23 respectively, which are deeply embedded into the glass insulator support rods 12. In the case of the terminal electrode 23, the peripheral projections 46 are part of an apertured plate 48 attached to the open end of the cup member of the terminal electrode 23. The resistive lens structure 42 also includes a plurality of apertured electrode plates 50 (FIG. 3) alternately stacked with a plurality of rectangular parallelepiped spacer blocks 52. A pair of the spacer blocks 52 are disposed between every two adjacent electrode plates 50. The spacer blocks 52 are disposed on opposite sides of the central one of three in-line apertures 53 provided in the electrode plates 50, and adjacent to an outer edge of the electrode plates. At least one block of each pair of spacer blocks 52 comprises a resistive block 54 as hereinafter described. The other block of the pair of spacer blocks 52 may comprise either a resistive block 54 or an insulator block 56. When only one resistive block 54 is desired between a pair of electrode plates 50, an insulator spacer block 56 also included for mechanical support purposes. In the drawings, the resistive blocks 54 are shown stippled to distinguish them from the insulator blocks 56.

The insulator blocks 56 may be made of any insulating material suitable for assembly with the electrode plates and compatible with conventional electron tube thermal and vacuum processing. Conventional ceramics, such as high grade alumina, are preferred.

Figure 4:
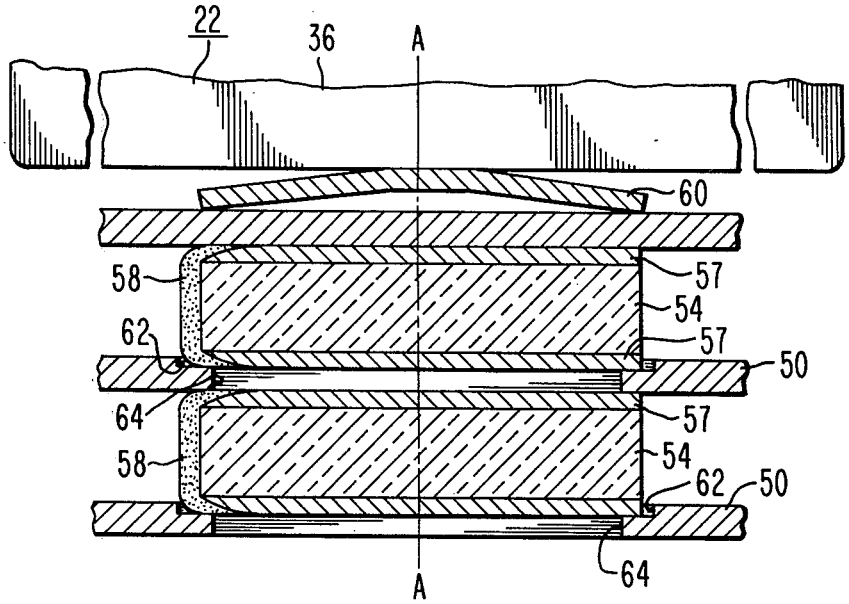
FIG. 4 is an enlarged section of a portion of the electron lens of the novel electron gun showing details of the spring means and the electrode plates and resistive blocks of the electron lens structure.

As shown in FIG. 4, the resistive blocks 54 preferably comprise insulator blocks having the pair of opposite surfaces which are in contact with two of the electrode plates 50 coated with electrically separate metallic conductive films 57. A surface connecting the two film-coated surfaces is coated with a layer 58 of a suitable high resistive material, which overlaps portions of the surfaces of the two metallic films 57 so as to make good electrical contact therewith.

The electrode plates 50 and the spacer blocks 52 (the resistive blocks 54 and the insulator blocks 56) are stacked in their alternating arrangement in loose fashion and disposed between the terminal electrodes 22 and 23. The electrode plates 50 and blocks 52 are secured in place and maintained in electrical contact by two pair of springs 60 which are attached to the terminal electrodes 22 and 23 substantially in line with the stacked rows of spacer blocks 52 and urge the stack of electrode plates 50 and blocks 52 together in an axial direction parallel to the beam paths 24.

Figure 3:
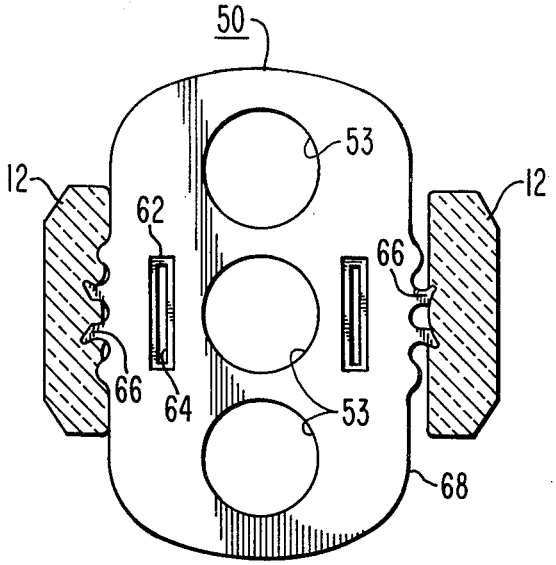
FIG. 3 is a plan view of an electrode plate for the novel electron gun illustrating details of two alternative embodiments of typical electrode contact with supporting glass rods.

As shown in FIGS. 3 and 4 the electrode plates 50 include, on opposite sides of their center apertures 53, a pair of rectangular coined recesses 62 into which the resistive blocks 54 are loosely seated. A rectangular aperture 64 is provided in the plate where the recess is to be coined to permit better flow of the metal of electrode plates 50 during the coining process. The precise alignment of the electrode plates is provided by mandrels disposed through the apertures 53 during the beading, i.e. embedment of the gun electrodes onto the glass support rods 12.

FIG. 4 also best shows the disposition and operational mechanism of the springs 60. The spring 60 shown in FIG. 4 is one of two welded at their midpoints to the terminal electrode 22. The spring 60 comprises a strip leaf of spring metal, e.g. Inconel alloy, with its two ends displaced away from the electrode 22 and bearing against the first electrode plate 50. The springs 60 thus urge the electrode plates 50 and the resistive blocks 54 into good electrical contact in the direction of the axis A—A of FIG. 4), which is parallel to the beam paths 24 shown in FIG. 2. Each of the springs 60 may be a ribbon 200 mils (5.08 mm) in length (left to right in FIG. 4), 50 mils (1.27 mm) in width (perpendicular to the drawing in FIG. 4), and 10 mils (0.254 mm) thick. Typically, the ends of the spring 60 may be displaced about 20 mils (0.508 mm) from the electrode 22.

As shown in FIG. 3 the electrode plates 50 include, along their long sides, beading claws 66 which lightly contact or are lightly embedded in the glass support rods. The purpose of contact between the claws 66 and the glass support rods 12 is to prevent lateral movement (in the plane of the drawing of FIG. 3) of the electrode plate without preventing a compression of the electrode plates 50 and the resistive blocks 54 into good electrical contact by the springs in the axial direction perpendicular thereto. For this reason, this contact should not be excessive. Specifically, the claw 66 should not be embedded into the support rod 12 as deeply as are the projections 44 and 46 of the terminal electrodes 22 and 26 where a rigid mounting is desired. Optimally, the claws 66 are embedded into the glass rods enough to insure that, with the given manufacturing tolerances present, the tips of the claws will make sufficient contact with the rods in all cases to prevent lateral movement of any of electrodes 50 in a manufacturing production run of electron guns.

Typically, the claws 66 may extend about 50 mils (1.27 mm) from the edge 68 of the electrode plate 50. In conventional state of art fabrication techniques, optimum contact or embedment may be approximately 20 mils (0.508 mm) as shown with the bead 12 on the right side of the FIG. 3 electrode 50. A typical tolerance of plus or minus 15 mils will then insure at least 5 mils of embedding contact. At a maximum, the embedment should not exceed 50 mils (the total length of the claws 66) as shown with the bead 12 on the left side of the FIG. 3 electrode 50. If this maximum is significantly exceeded, axial spring urging of the electrode plates 50 may be deterred. Furthermore, scrap due to cracked beads 12 and cracked resistive blocks 54 may be excessive. The incidence of cracked beads, which requires scrapping of an entire electron gun, is almost directly proportional to the number of embedments into the bead, and also increases with increased depth of embedment. Since the novel gun includes several electrode plates 50, incidence of cracked beads could be unacceptably high if each of these electrodes were to be deeply embedded in the bead for fixed mounting thereon. Thus the novel gun by virture of only light contact between the electrode plates 59 and the glass beads 12 avoids the otherwise high incidence of cracked beads without sacrificing lateral alignment stability.

Experience in fabrication of the novel electron guns also reveals that the resistive blocks 64 can easily be cracked, and electrical continuity thus destroyed, if molten glass from deep beading comes in contact with the blocks.

As a design variation of the resistive lens 42, the electrode plates 50 could be more deeply embedded in the beads 12 and the springs 60 made stronger to insure the required axial contact between electrode please 50 and resistive blocks 54. However, this is not preferred since it aggravates the cracked bead problem which the novel gun is designed to reduce in the first place. Moreover, use of stronger springs 60 make assembly more difficult.

Although the electron gun 10 is shown with two pairs of springs 60, one pair at each side of the lens stack, the novel lens could be fabricated using only one pair of springs. However, use of two pairs gives greater assurance that the axial urging of the electrode plates and resistive blocks into contact will occur completely along the stack. If only one pair of springs 60 are used, it may be desired to dispose them near the middle of the lens stack. This will insure more even spring force all along the stack than to have the single pair of springs at one end of the stack. However, a midpoint disposition of the springs could cause a perturbation in the potential profile along the lens stack which might be objectional. Whether or not it is objectional, would depend upon the design of the lens as to its electrical potential distribution.

Although the springs 60 can be made to bear directly onto a pair of spacer blocks 52, such arrangement is not preferred because of the less even distribution of the spring force into the stack and because of the possibility of a more difficult parts assembly procedure.

The relative sizes of the electrode plates, resistive blocks 54, and glass beads 12 are not critical to this invention. Other electrodes of the electron gun 10 and the support beads 12 which are capable of withstanding the embedment of these electrodes therein will determine the maximum size of the electrode plates 50. However, since the electrode plates 50 are not deeply embedded into the beads 12, the beads can be stepped down in size along the lens stack 42, as shown in FIG. 1. This will allow maximum sizing of the electrode plates 50, which will contribute to better electron optics and better high voltage stability.

In accordance with one specific example, fabrication of the resistive blocks 54 is performed by first lapping a good quality $Al_2O_3$ plate, e.g. (Alsimag #771 or #772) from slightly thicker stock to dimensions 2 inches×2 inches×0.040 inch (50.8×50.8×1.016 mm). The large opposite faces of the plate are then provided with the metal films 57 by sputtering first a thin layer of titanium and then a layer of tungsten, onto the $Al_2O_3$ plate.

The plate is then cut into 200 mil (5.08 mm) wide pieces with a diamond saw. The pieces are inserted in a holder which leaves exposed one of the 2-inch bare $Al_2O_3$ faces, and about one third of the Ti/W covered faces. A W-$Al_2O_3$ cermet is then sputtered onto the thus exposed areas of the piece to provide the resistive coating 58 as shown in FIG. 4. The overlap of the resistive layer 58 onto the metal film 57 provides good electrical contact.

The pieces are then annealed to bring the through resistance to convenient values (about $10^8$ to $10^{10}$ Ω for the finished blocks). Although selective annealing will provide selective resistivity, it is not feasible to monitor resistivity while the blocks are in the annealing furnace because at temperatures above 400° C. the conductivity of the ceramic is appreciable. Nevertheless, with a few measurements obtained by removing selected pieces from the furnace, it is possible to closely reproduce any desired distribution of resistances for a given annealing run. Following annealing, the pieces are diced into blocks which are 200 mils (5.08 mm)×40 mils (1.016 mm)×40 mils (1.016 mm) having one of the 40×40 mil faces covered with the resistive coating 58.

The following Table summarizes typical sputter schedules and layer thicknesses in one preferred example of resistive block fabrication.

| Material | Time (minutes) | Thickness (microns) |
|---|---|---|
| Ti | 17 | 0.1 |
| W | 35 | 0.2 |
| W—$Al_2O_3$ | 240 | 0.7 |

Various dimensional relationships, resistance values and materials can be used in fabricating the resistive lens structure 42. Choice of these parameters will depend upon the particular electron gun structure and the equipment for which it is intended. It is usually desirable to operate the voltage bleeder provided by the high resistance coatings 58 with a bleeder current of from 5–10 microamps and with a power dissipation of 0.5 watt or less. Typical voltage gradients usually employed along the resistive coatings 58 are in the range of 2.5–4.0×$10^4$ volts per centimeter.

Materials which have been found to be suitable for the electrode plates 50 include molybdenum, stainless steel, or any other metal compatible with the fabrication techniques employed. Alumina ceramics are preferred for the spacer blocks.

Alumina spacer blocks 52 have been suitably metallized with molybdenum metallization applied by well known inking techniques or by sputtering on titanium-tungsten metallized coatings.

The shape of the spacer blocks 52 is not critical. Simple rectangular blocks are preferred. Neither is the positioning of the blocks 52 on the electrode plates 50 critical. However, the blocks are preferably spaced away from the electrode apertures 53 a distance at least as great as the thickness of the blocks so as to avoid excessive interference with the lens fields in the apertures, and spaced back from the edge of the electrode plates a distance, e.g. 15 mils (0.381 mm), to minimize arcing between them and other parts of the electron tube.

Sputter-deposited cermet materials as described in U.S. Pat. No. 4,010,312 to Pinch et al are preferred for use as the high resistance coating 58. Adjustment of resistivity as taught in this patent can be practiced in order to obtain the desired overall resistance for the particular electron gun into which the resistive lens structure is incorporated. The thickness of such coatings can be significantly varied and a desired resistivity obtained by appropriate annealing as taught in the Pinch et al patent. Suitable coatings have been made from about 0.35 to about 0.7 micron thickness, but these values are considered only as a preferred range and not operable limits. To this end the Pinch et al patent is incorporated herein by reference for purpose if its disclosure.

Alternatively, resistive inks can be used for the coatings 58 provided they possess the desired high resistance. Generally speaking, any resistive material which provides suitably high resistance values and is compatible with lens assembly and electron tube fabrication schedules can be used.

In one example of the novel resistive lens structure 42, the electrode plates 50 were made of 10 mil (0.254 mm) thick stainless steel. Three in-line apertures 53 were provided having diameters of 160 mils (4.064 mm) spaced 200 mils (5.08 mm) apart. The spacer blocks 52 were of alumina and were 40 mils (1.016 mm) thick and 200 mils (5.80 mm) long and coated with titanium-tungsten metal films 57. Seven electrode plates 50, and six pair of spacer blocks 52 were used. The spacer blocks consisted of two resistive blocks 54 in each of the first two stages of the lens and one resistive block 54 and one insulator block 56 in each of the last four stages of the lens. The resistive coatings 58 for this lens structure were provided by sputter depositing a 0.7 micron thick cermet layer having a resistance from plate to plate of approximately $10^9$ ohms. The lens was operated with a focus potential of 5300 volts on the second accelerating and focus electrode 22 and an ultor potential of 25,000 volts on the third accelerating and focus electrode 23. The first accelerating and focus electrode 20 was connected to the middle electrode plate 50 to provide it with a potential of 13,180 volts.

What is claimed is:

1. An electron gun comprising a cathode and two apertured terminal lens electrodes mounted in fixed relationship axially along a plurality of glass support rods, and a resistive lens stack disposed between said terminal electrodes and mechanically and electrically secured thereto, said resistive lens stack comprising a plurality of apertured electrode plates alternately stacked with a plurality of resistive spacer blocks, and spring means contacting said stack and axially urging said electrode plates and said resistive blocks into mutual electrical contact with each other and with said terminal electrodes, whereby said stack has a highly resistive electrically continuity from one of said terminal electrodes to the other of said terminal electrodes.

2. The electron gun of claim 1 wherein said electrode plates are lightly contacted by said glass support rods but are not deeply embedded into said glass support rods, whereby said electrode plates are secured against lateral movement but are relatively free to be axially urged by said spring means into good electrical contact with adjacent ones of said resistive blocks.

3. The electron gun of claim 1 wherein at least one plate contacting each block is provided with a recess for receiving and positioning said blocks.

4. The electron gun of claim 1 wherein said stack includes two spacer blocks between each adjacent pair of said electrode plates, at least one of said spacer blocks between any two adjacent plates being a resistive block.

5. The electron gun of claim 4 wherein said spacer blocks are disposed in two parallel axial stacks and said spring means comprises a pair of leaf springs, one spring being disposed in substantial alignment with each of said axial stacks of blocks.

6. The electron gun of claim 5 wherein said pair of leaf springs are disposed substantially midway between the ends of said resistive lens stack.

7. The electron gun of claim 5 wherein said spring means comprises two pair of leaf springs with one pair being disposed at each end of said resistive lens stack.

* * * * *